US011559828B2

(12) United States Patent
Johnson et al.

(10) Patent No.: US 11,559,828 B2
(45) Date of Patent: Jan. 24, 2023

(54) PLANT PRODUCT EXTRACTION APPARATUS

(71) Applicant: Chad M. Johnson, Frankfort, IL (US)

(72) Inventors: Chad M. Johnson, Frankfort, IL (US); Matthew Long, Lakemoor, IL (US); Paul Herrera, St. Charles, IL (US)

(73) Assignee: Chad M. Johnson, Frankfort, IL (US)

( * ) Notice: Subject to any disclaimer, the term of this patent is extended or adjusted under 35 U.S.C. 154(b) by 31 days.

(21) Appl. No.: 17/168,866

(22) Filed: Feb. 5, 2021

(65) Prior Publication Data

US 2021/0245199 A1 Aug. 12, 2021

Related U.S. Application Data

(60) Provisional application No. 62/971,440, filed on Feb. 7, 2020.

(51) Int. Cl.
*B07B 1/38* (2006.01)
*B07B 1/42* (2006.01)
(Continued)

(52) U.S. Cl.
CPC ..... *B07B 1/38* (2013.01); *B07B 1/30* (2013.01); *B07B 1/40* (2013.01); *B07B 1/42* (2013.01)

(58) Field of Classification Search
CPC .... B07B 1/38; B07B 1/30; B07B 1/40; B07B 1/42
See application file for complete search history.

(56) References Cited

U.S. PATENT DOCUMENTS 1,500,850 A * 7/1924 Rush ..... B07B 1/30 209/365.2
2,723,031 A 11/1955 Sweet
(Continued)

FOREIGN PATENT DOCUMENTS

CN 101966519 A * 2/2011
CN 202045073 U * 11/2011
(Continued)

OTHER PUBLICATIONS

"The Kief Thief: Dry Sift Extractor" Web page <http://thekiefthief.com/>, 1 page Nov. 18, 2018, retrieved from Internet Archive Wayback Machine <http://web.archive.org/web/20181118052107/https://thekiefthief.com/#> on Jun. 22, 2021.
(Continued)

*Primary Examiner* — Patrick H Mackey
(74) *Attorney, Agent, or Firm* — Gardner, Linn, Burkhart & Ondersma LLP

(57) ABSTRACT

A plant product extraction apparatus or extractor is provided for separating or grading fine particles from a larger portion of material, such as separating trichomes from a stalk or flower of a plant. The apparatus imparts a plurality modes or patterns of oscillations and vibrations to a particle separator or sieve that holds the plant matter. A motor drives a back and forth motion to a support platform supporting a sieve. The sieve is constrained by a retention tray that is supported by the support platform. Vibratory motors provide rapid shaking vibration through the retention tray to the sieve. Agitators may be placed inside of the sieve to facilitate the separation of the plant materials. The various motors and locomotion patterns facilitate the separation of finer plant materials from a larger portion of a plant.

20 Claims, 7 Drawing Sheets

(51) Int. Cl.

| | |
|---|---|
| ***B07B 1/30*** | (2006.01) |
| ***B07B 1/40*** | (2006.01) |

(56) References Cited

U.S. PATENT DOCUMENTS

| | | | | |
|---|---|---|---|---|
| 2,831,576 | A | 4/1958 | Wehner | |
| 2,874,841 | A | 2/1959 | Peterson | |
| 2,947,410 | A | 8/1960 | Carrier, Jr. | |
| 3,161,587 | A | 12/1964 | Bach | |
| 3,581,598 | A | 6/1971 | Allgaier et al. | |
| 3,790,091 | A | 2/1974 | Law et al. | |
| 4,125,335 | A | 11/1978 | Blume et al. | |
| 4,233,151 | A | 11/1980 | Gundlach | |
| 4,307,808 | A * | 12/1981 | Johnson | A47J 43/22 209/675 |
| 4,319,991 | A | 3/1982 | Crone, Jr. et al. | |
| 5,108,588 | A | 7/1992 | Yu | |
| 6,029,822 | A | 2/2000 | Skoropa | |
| 6,425,485 | B1 | 7/2002 | Mankosa et al. | |
| 7,377,960 | B2 | 5/2008 | Bertram et al. | |
| 8,640,877 | B1 | 2/2014 | Pastorius | |
| 8,943,745 | B2 | 2/2015 | Sexton et al. | |
| 9,010,540 | B2 | 4/2015 | Smith et al. | |
| 9,718,065 | B1 | 8/2017 | Cilia | |
| 9,782,801 | B2 | 10/2017 | Alamzad et al. | |
| 10,227,729 | B2 | 3/2019 | Mohammadi et al. | |
| 10,357,802 | B2 | 7/2019 | Lunnemann et al. | |
| 2011/0023433 | A1 | 2/2011 | Lafargue et al. | |
| 2014/0048456 | A1 * | 2/2014 | Adams, Sr. | B07B 1/06 209/325 |
| 2016/0108555 | A1 | 4/2016 | Rosado | |
| 2017/0001200 | A1 | 1/2017 | Leffel | |
| 2017/0202896 | A1 | 7/2017 | Hugh | |
| 2018/0193880 | A1 | 7/2018 | Dumbaugh | |
| 2019/0201936 | A1 | 7/2019 | Rystadt et al. | |

FOREIGN PATENT DOCUMENTS

| | | | | |
|---|---|---|---|---|
| CN | 205946615 | | 2/2017 | |
| CN | 107470138 | | 12/2017 | |
| CN | 206951575 | | 2/2018 | |
| CN | 107812706 | | 3/2018 | |
| CN | 106179950 | | 7/2018 | |
| CN | 109046940 | A * | 12/2018 | B07B 1/28 |
| GB | 2351927 | | 1/2001 | |
| NL | 1005871 | | 10/1998 | |

OTHER PUBLICATIONS

YouTube Video, "Dry Sift Solutions DS1000R", published Oct. 18, 2016, accessed Jun. 22, 2021, https://www.youtube.com/watch?v=FffaLh7L_4o.

"PollenMasters: Dry Sift Tumbler" Web page <http://www.pollenmasters.com>, 1 page Nov. 18, 2018, retrieved from Internet Archive Wayback Machine <http://web.archive.org/web/20181118055552/https://www.pollenmasters.com/> on Jun. 22, 2021.

"Bubble Man's Tumble Now Machine" Web page <https://www.bubblebag.com/tumblenow.php>, 1 page Apr. 19, 2018, retrieved from Internet Archive Wayback Machine <https://web.archive.org/web/20180419095534/https://www.bubblebag.com/tumblenow.php> on Jun. 22, 2021.

YouTube Video, "Rosin Industries Pollenex in action", published Jan. 9, 2018, accessed Jun. 22, 2021, https://www.youtube.com/watch?v=l2jJpX-WKhY.

"Bubble Now" Web page <http://www.bubblebag.com/bubblenow.php>, 1 page Apr. 14, 2018, retrieved from Internet Archive Wayback Machine <https://web.archive.org/web/20180414014652/http://www.bubblebag.com/bubblenow.php> on Jun. 22, 2021.

"Dry Sift Wizard: 3 Screen Kit Dry Sifter" Web page <http://drysiftwizard.weebly.com/store/p1/3_Screen_kit_-_Top,_bottom,_refine.__.html >, 1 page Jul. 7, 2016, retrieved from Internet Archive Wayback Machine <https://web.archive.org/web/20160707203316/http://drysiftwizard.weebly.com/store/p1/3_Screen_kit_-_Top%2C_bottom%2C_refine.__.html> on Jun. 22, 2021.

* cited by examiner

PLANT PRODUCT EXTRACTION APPARATUS

CROSS REFERENCE TO RELATED APPLICATION

The present application claims priority of U.S. provisional application Ser. No. 62/971,440, filed Feb. 7, 2020, which is hereby incorporated herein by reference in its entirety.

FIELD OF THE INVENTION

The present invention is directed to a particle separation apparatus, and in particular an apparatus for separating finer particles of a plant from a larger portion of the plant.

BACKGROUND OF THE INVENTION

Separating plant or herb particles from the entire plant or larger portion of a plant include manually or mechanically sifting the plant material to separate the finer portion of the plant matter, such as herbal extract. Manual devices used include sieves, tumblers, or bubble bags. Mechanical devices separate fine particles from plants with vibration. Separation of plant particles is a time consuming process often requiring extensive physical labor or expensive, large-scale equipment.

SUMMARY OF THE INVENTION

The present invention provides a plant product extraction apparatus or a particle size separating apparatus for extracting or separating and segregating smaller size products of a plant or other material from a larger portion of the plant or material. The apparatus employs a plurality of motors to drive a plurality of vibrations or oscillations to a particle separation apparatus or separator, such as a sieve or similar apparatus, to facilitate separation of different product or particle sizes of the material that is being sifted. The apparatus generates a plurality of patterns and/or amplitudes of vibration and oscillation to aid in the separation of plant products. The apparatus is adept at removing fine plant matter, such as trichomes or herbal extracts, from larger portions of the plant, such as leaves and stalks. However, the apparatus is also useful for separation or gradation of different particle sizes of a material, such as for soil gradation analysis. The extraction apparatus is particularly useful for table top or benchtop use to allow a user to extract plant products from a low volume of material, although it may be scaled and adapted for use with large volumes of material.

According to a form of the present invention, a particle extraction apparatus is provided for separating smaller portions or particles of a product or material, such as a plant, from a larger portion of the material. For example, separating trichomes from leaves, stalks, or flowers of a plant. The extraction apparatus includes an oscillation assembly or oscillator to impart a form of oscillation to a separator and a vibration assembly or vibrator to impart a form of vibration to the separator. The oscillator and the vibrator both act to move the separator to facilitate separation of the small particles from the larger portion of material. The oscillator and vibrator may be operated independently or in coordination with one another, and may impart different modes, patterns, or types of vibration or oscillation to the separator.

In one aspect, the plant product extraction apparatus includes a separator retention platform or tray disposed on a support platform. The support platform is configured to move or slide back and forth horizontally to impart a reciprocating oscillation to the separator. A support rail assembly is provided to support the support platform and to define a horizontal and/or linear travel path for the support platform. The support rail assembly includes one or more support or guide rails along which the support platform is moveably supported. The oscillator is configured to mechanically drive the support platform back and forth along the support rail. The retention tray is configured to retain the separator horizontally relative to the support platform such that as the support platform oscillates back and forth, the separator is substantially constrained from lateral movement relative to the support platform, i.e. the separator does not slide off the support platform during operation of the extraction apparatus.

In another aspect, the oscillator includes a motor coupled to a first end of a linkage assembly. The motor drives the linkage assembly in a reciprocating motion. The linkage assembly is coupled at a second end to the support platform such that the reciprocating motion of the linkage assembly drives the horizontal back and forth oscillation of the support platform. The separator is retained in the retention tray and experiences the back and forth oscillation as the support tray is driven back and forth along the rail. The vibrator includes a vibratory motor disposed on or inside of a portion of the retention tray such that the vibratory motor imparts a vibration or shaking to the retention tray and thereby to the separator.

In yet another aspect of the present invention, isolators are disposed between the support platform and the retention tray, or are disposed on mechanical fasteners that secure the retention tray to the support platform. The isolators permit limited vertical and horizontal translation of the retention tray relative to the support platform. The limited vertical and horizontal translation of the retention tray further facilitates separation of the plant materials. In a further aspect, a plurality of agitators may be disposed inside of the separator to interact with the plant material to facilitate separation of smaller plant materials from a larger portion of the plant.

In another form of the present invention, a plant matter separation apparatus is provided for separating smaller portions or particles of a plant from a larger portion of the plant. The extraction apparatus includes a support base for supporting a pair of parallel rails in spaced arrangement, a support platform slideably coupled to the pair of rails and configured to move freely along the rails in the direction parallel to the rails, and a retention tray coupled to the support platform. The retention tray is configured to receive and horizontally constrain a separator relative to the support platform. The separation apparatus includes a linear drive assembly adapted to drive the support platform horizontally back and forth along the parallel rails relative to the support base. The separation apparatus further includes a vibratory motor coupled with the retention tray, and the vibratory motor is adapted to shake the retention tray and thereby shake the separator retained in the retention tray. The linear drive assembly and the vibratory motor cooperate to vibrate the separator to facilitate separation of smaller plant materials from a larger portion of the plant.

In one aspect, the extraction apparatus includes a pair of vibratory motors, each disposed at an opposite end of the retention tray. Each of the vibratory motors is an eccentric rotating mass motor having a cylindrical body. The vibratory motors are oriented on the retention tray such that the longitudinal axis of the vibratory motor's cylindrical body is oriented perpendicular to the pair of parallel rails. Each vibratory motor is configured to impart a shaking vibration to the retention tray in a direction perpendicular to the longitudinal axis of the vibratory motor. Optionally, the longitudinal axis of the cylindrical body of the vibratory motors may be oriented in a direction other than perpendicular to the parallel rails to alter the direction of vibration from the vibratory motors relative to the rails.

In yet another aspect, the support base includes a hollow chamber formed in an interior of the support base. The moving components of the apparatus are confined inside of the hollow chamber, such as including the support rails, the particle separation apparatus, the retention tray, the drive assembly, and the vibratory motor. In other words, the operation movements of the particle extraction apparatus are confined within an envelope defined by the hollow chamber. Confining the moving components in the hollow chamber reduces or eliminates the potential that a user will be injured while the plant extraction apparatus is operating and also protects the moving components from being impacted or jammed by foreign objects.

Accordingly, the plant product extraction apparatus imparts vibratory or oscillatory motion to a sieve to extract and separate finer plant particles from a larger portion of a plant that is disposed inside of the sieve. The extraction apparatus enables multiple patterns and forms of vibration and oscillation to facilitate separation of the finer materials from the larger material. The extraction apparatus provides for home and personal use separation and extraction of fine particles from a larger material. While the embodiments of the present invention are directed to separating smaller portions or particles of plant materials from a larger portion of the plant, it will be appreciated that the extraction apparatus may be used with other materials. For example, the extraction apparatus may be used to grade or segregate different particle sizes of materials such as for particle gradation analysis.

These and other objects, advantages, purposes and features of this invention will become apparent upon review of the following specification in conjunction with the drawings.

DESCRIPTION OF THE PREFERRED EMBODIMENTS

Figure 1:
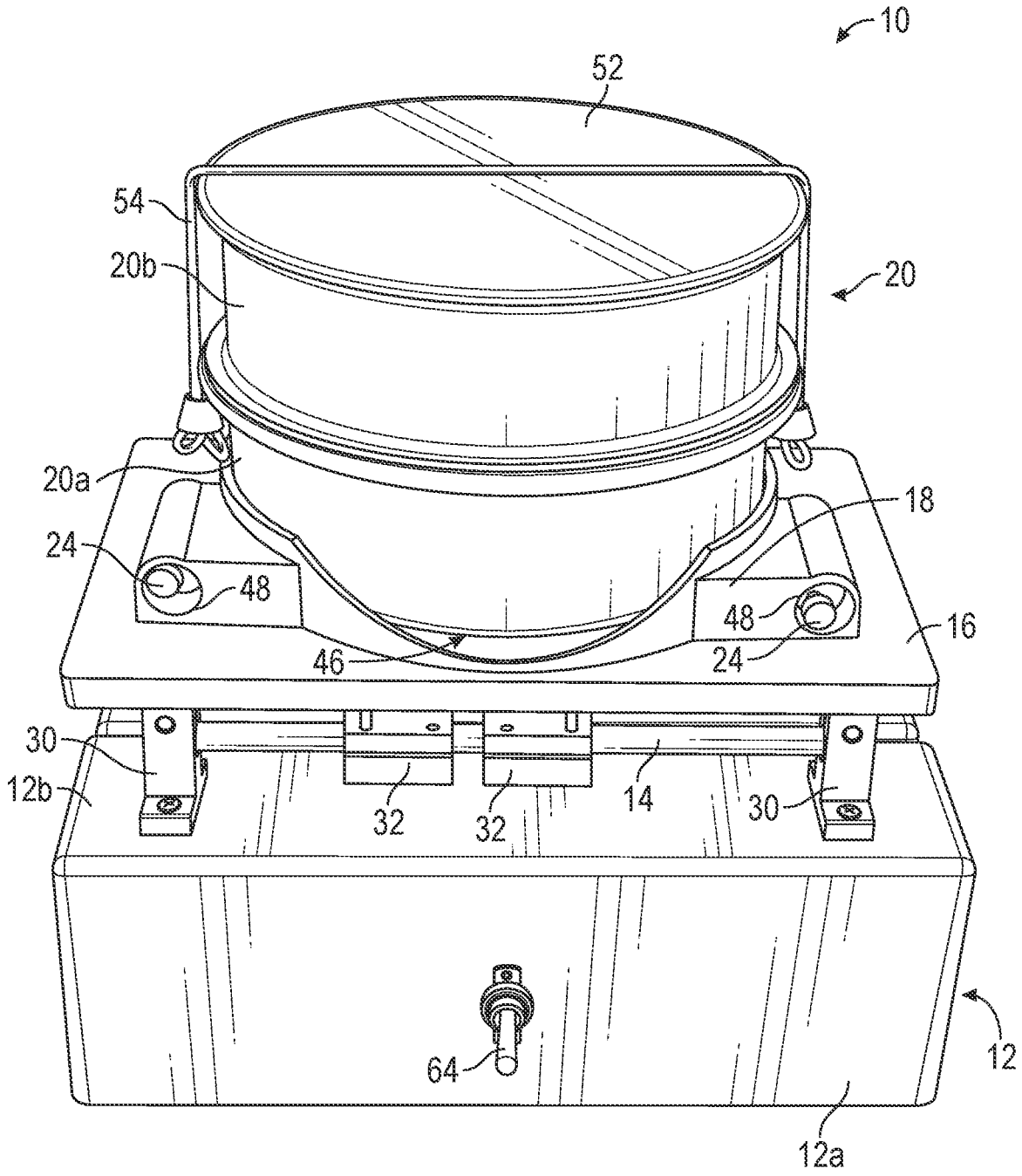
FIG. 1 is a front perspective view of a plant product extraction apparatus in accordance with the present invention.

Referring now to the drawings and the illustrative embodiments depicted therein, a plant product extraction apparatus 10 is provided for separating a finer material from a larger portion of material or a mixture of different sizes of material, such as separating trichomes or herbal extracts from a flower, leaf, or stalk of a plant. The plant extraction apparatus 10 includes a plurality of motors or other oscillation/vibration devices to agitate a particle separation apparatus or separator, such as a sieve 20, in a plurality of vibratory/oscillatory modes or patterns. The separator may be a standard test sieve set having one or more sieves with varying mesh sizes or gradations to separate multiple material sizes, or any other suitable container to contain a material and to segregate, separate, grade, or sift off particles of material from the larger portion of material. The plant product extraction apparatus 10 may be configured for home use such as for table tops or workbench tops, or may be adapted for large scale applications.

For purposes of this disclosure, the term "oscillation" refers to a substantially defined repetitive motion along an expected path having a longer wavelength and/or a larger defined amplitude, i.e. linear back and forth sliding or shimmying, and the term "vibration" refers to a less defined repetitive motion having a potentially erratic path and having a shorter wavelength and/or a smaller defined amplitude, i.e. non-linear rapid shaking or constrained repetitive motion, such as may be provided by commonly known eccentric rotating mass motors or transducers, for example.

Figure 6:
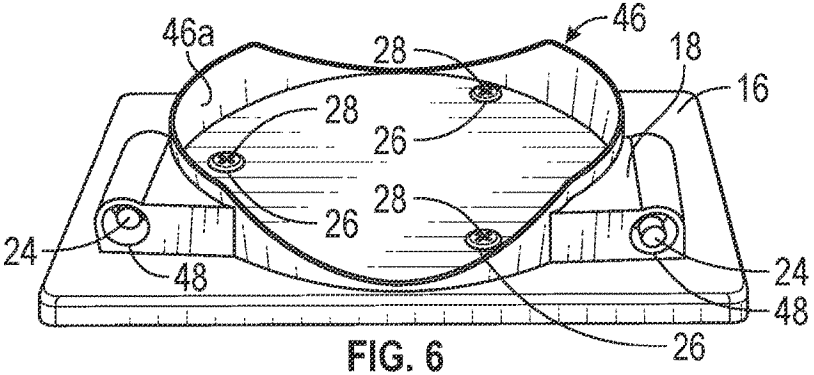
FIG. 6 is a perspective view of the sieve retention tray of FIG. 5 supported on a support platform.
Figure 7:
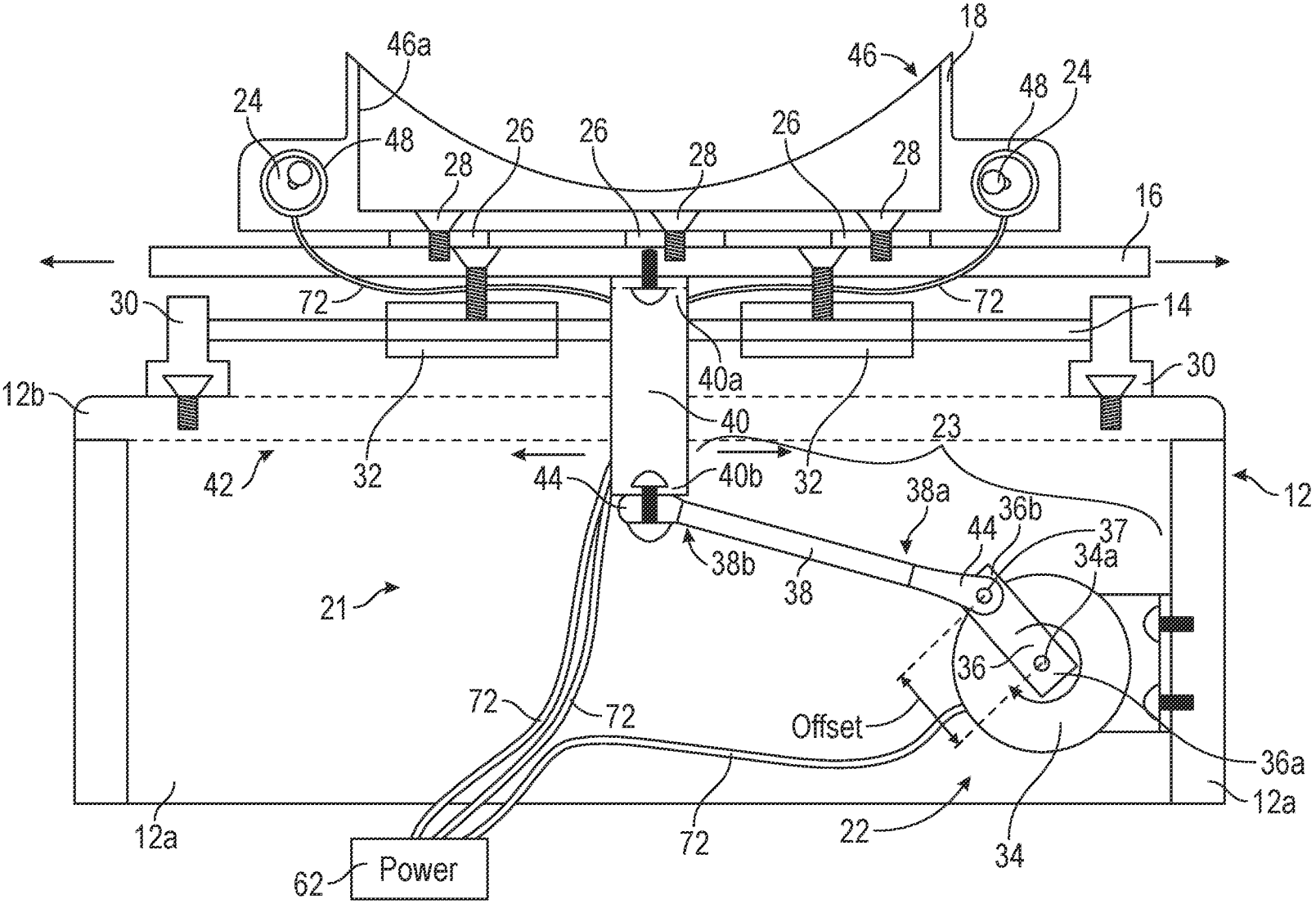
FIG. 7 is a front sectional view of the plant product extraction apparatus of FIG. 1, depicted with a sieve assembly omitted.
Figure 9:
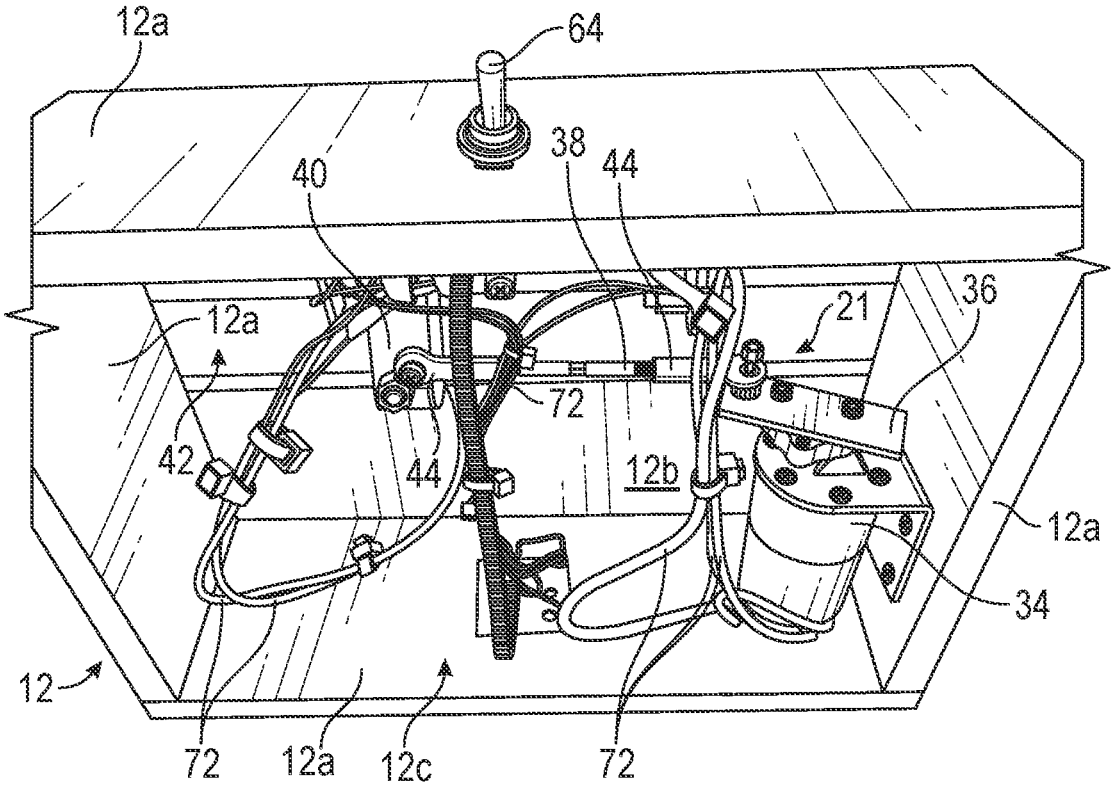
FIG. 9 is a bottom front perspective view of the extraction apparatus of FIG. 1.

In the illustrated embodiments of FIGS. 1-4, a plant product extraction apparatus 10 includes a support base 12, a pair of linear support or guide rails 14 coupled to the support base 12, a slidable support platform 16 that is slidable along the support rails 14, and a sieve retainer or retention tray 18 that is configured to retain a sieve 20 with respect to the support platform 16. The support platform 16 is configured to translate back and forth relative to the support base 12 to provide a back and forth oscillation to the sieve 20. A linear drive system 21 is provided to mechanically drive the support platform 16 back and forth along the support rails 14 (FIG. 7). The linear drive system 21 includes a motor assembly 22, such as an electric rotary motor, coupled to a linkage assembly 23. The motor assembly 22 and linkage assembly 23 cooperate to provide locomotion to the support platform 16 to drive the back and forth motion (FIGS. 7 and 9). A vibratory motor 24 is disposed with the sieve retainer tray 18 to impart a vibration to the sieve 20 (FIGS. 1-7). The vibratory motor 24 can impart a shaking vibration directly to the sieve retainer tray 18, including imparting vertical and horizontal vibration as a result of play (limited freedom of relative movement) due to clearances between the sieve retainer tray 18, the support platform 16, and mechanical fasteners 28 that secure the tray 18 to the platform 16. The motor assembly 22 and the vibratory motor 24 can be operated in unison to impart both back and forth oscillation and shaking vibration to the sieve 20 at the same time. Although a motor assembly and linkage assembly are disclosed, other reciprocal drivers are envisioned, such as a pneumatic or hydraulic piston-cylinder arrangement, linear electric actuators, or non-electric motors.

The support base 12 is defined by a rectangular box having four side walls 12*a*, a top 12*b*, and an open bottom 12*c* having a perimeter defined by the side walls 12*a* (FIGS. 1-4 and 8-10). The walls 12*a* and top 12*b* define a substantially hollow space or chamber inside of the base 12. The base top 12*b* supports the support rails 14. The motor assembly 22 and a portion of the linkage assembly 23 are housed within the chamber interior of the base 12. The support rails 14, as illustrated in FIGS. 1-4, 7, and 8, are coupled to the support base top 12*b* at rail end supports 30. The rails 14 are positioned in spaced arrangement, with each rail 14 being positioned proximate a respective side of the support base top 12*b*. The rail end supports 30 are mechanically fastened to the support base top 12*b* and provide sufficient clearance between the support base top 12*b* and the rails 14 to allow for substantially free back and forth movement of the support platform 16. The rails 14 define a linear oscillation path upon which the support platform 16 can be driven or guided back and forth to agitate the sieve 20.

The support platform 16 is slideably mounted on the support rails 14 by a plurality of slide mounts 32 (see FIGS. 1-3, 4, 7, and 8). Each slide mount 32 includes a through-hole through the mount 32 to receive the support rail 14, such that the support rail 14 passes through the through-hole. Each slide mount 32 is retained around the respective support rail 14 in the directions that are perpendicular to the longitudinal axis of support rail 14 while allowing the slide mount 32 to substantially freely slide parallel to the support rail 14. The slide mounts 32 are mechanically fastened to a bottom side of the support platform 16. Although the support rails 14 are shown horizontal in the illustrated embodiment, the rails may be inclined relative to horizontal, or they may be substantially vertical. While a pair of rails are shown and described, a single support rail may slideably support the support platform 16 relative to the support base 12. Although the illustrated embodiment discloses a linear oscillation path defined by the support rails, the oscillation path could be defined by curvilinear rails to guide the oscillation along a curvilinear path. Optionally, rollers may be provided to moveably support the support platform 16, instead of rails and slide mounts.

Figure 4:
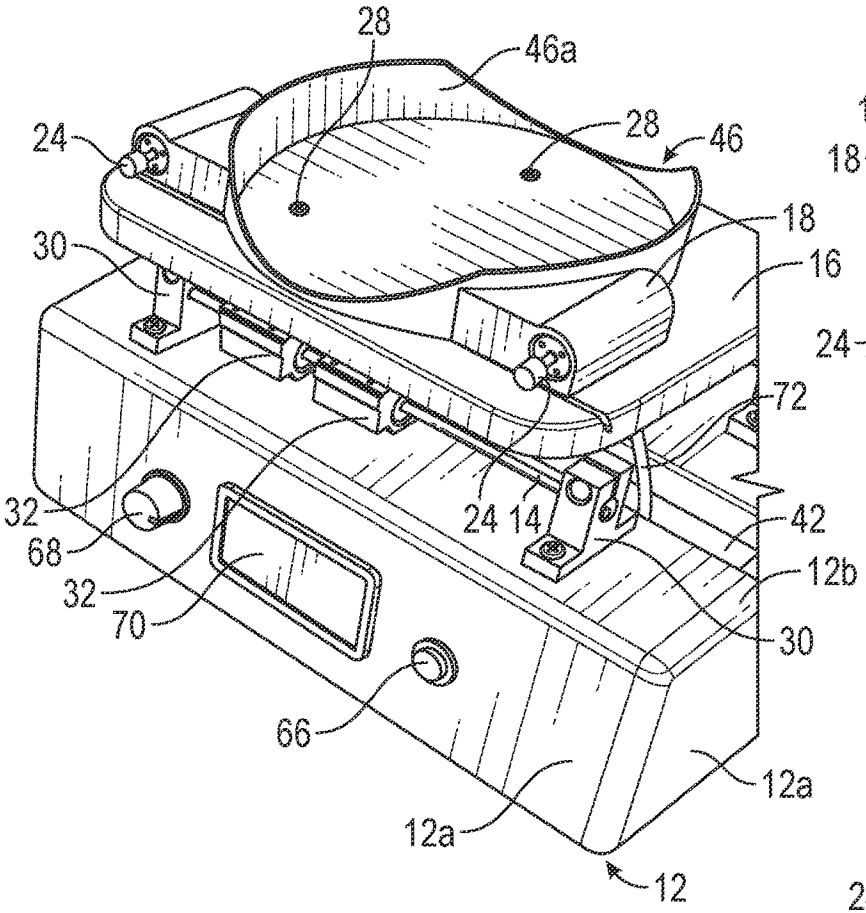
FIG. 4 is a front side perspective of another plant product extraction apparatus in accordance with the present invention.

The support platform 16 is formed of a sufficiently rigid material, such as wood, plastic, or metal, which is resilient to withstand repetitive oscillation while supporting the sieve retainer tray 18. The support platform 16 is defined by a substantially rectangular perimeter that is at least partially larger than the outer perimeter of the sieve retainer tray 18. Isolators 26, such as rubber bushings or washers, are disposed between the sieve retainer tray 18 and the support platform 16 (see FIG. 7), with mechanical fasteners 28 securing the tray 18 to the platform 16 (FIGS. 4 and 6). The isolators 26 are configured to permit limited movement of the sieve retainer tray 18 in a vertical direction and/or horizontal direction while reducing vibration transfer from the vibratory motor 24 through the sieve retainer tray 18 and into the support platform 16.

Figure 7A:
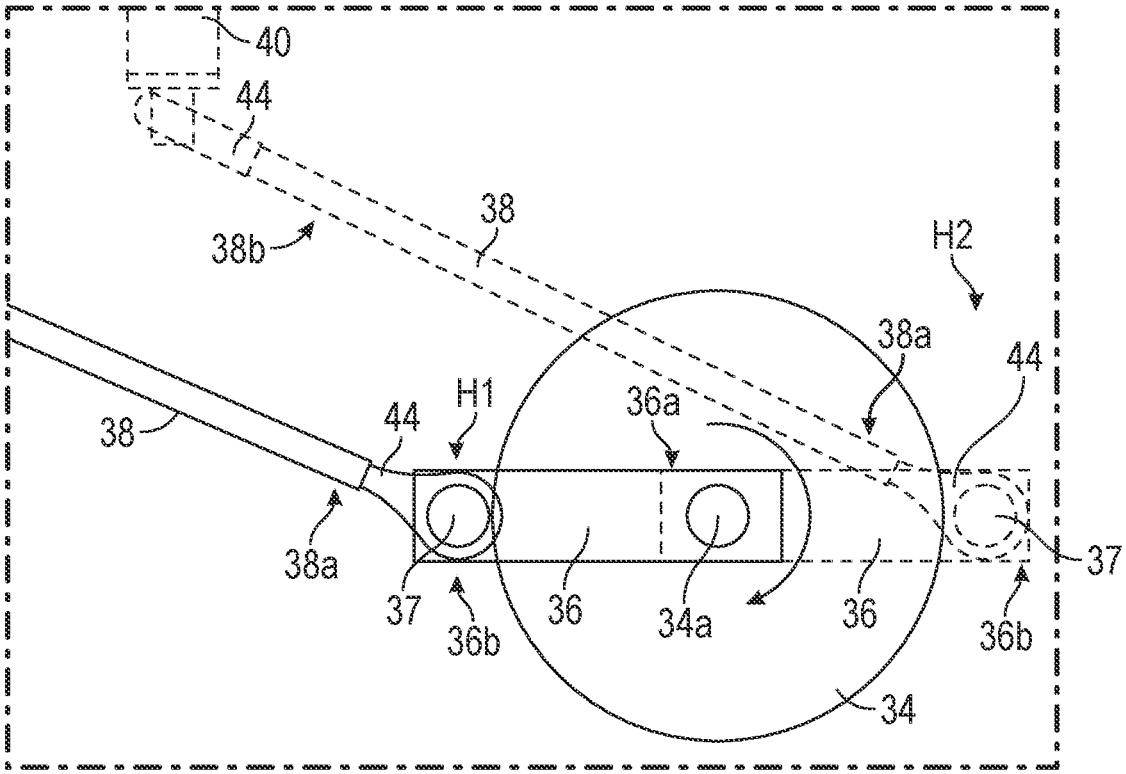
FIG. 7A is an enlarged sectional view depicting two possible operational positions of a rotary motor, gear arm, and drive arm during operation of the plant product extraction apparatus in accordance with the present invention.

As best shown in the illustrated embodiments of FIGS. 7 and 9, the linear drive system 21 includes a motor assembly 22 disposed within the support base 12, and a linkage assembly 23 that is disposed between the motor assembly 22 and the support platform 16. The linear drive system 21 is configured to mechanically drive a back and forth, linear horizontal oscillation of the support platform 16 relative to the support base 12. The motor assembly 22 includes a rotary motor 34 and a gear arm 36 that is fixed at a proximal end 36*a* to an output shaft 34*a* of the rotary motor 34 (FIGS. 7, 7A, and 9). During operation of the rotary motor 34, the output shaft 34*a* spins, causing the gear arm 36 to spin at the same rate of rotation as the output shaft 34*a*. As the gear arm 36 rotates the distal end 36*b* orbits around the rotational axis of output shaft 34*a*. The gear arm 36 provides an offset distance between the output shaft 34*a* and a connection pin 37 between the linkage assembly 23 and the gear arm 36 (FIGS. 7 and 7A). The offset distance is chosen as a function of the desired travel distance of the support platform 16. A longer offset distance will generate a longer longitudinal travel distance of the support platform 16, and vice versa.

Figure 8:
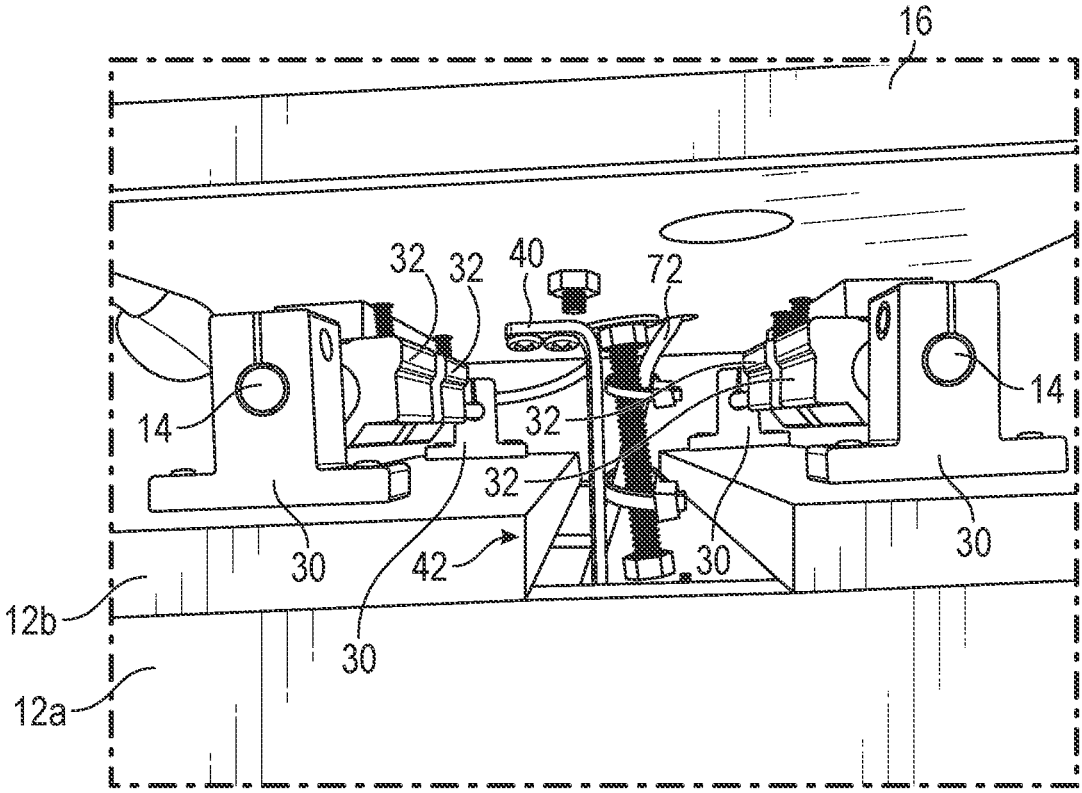
FIG. 8 is an enlarged perspective view of a platform support rail assembly for moveably supporting the platform of the extraction apparatus of FIG. 1.

The linkage assembly 23 includes a linkage drive arm 38 pivotally coupled at a first end 38*a* to the distal end 36*b* of the gear arm 36 and at a second end 38*b* to a distal end 40*b* of a vertical transfer arm 40 (FIGS. 7 and 7A). The proximal end 40*a* of the vertical transfer arm 40 is fixed to the support platform 16 and the transfer arm 40 is configured to transfer force from the linkage drive arm 38 to the support platform 16. The body of the vertical transfer arm 40 is disposed through an opening in the support base top 12*b* defined by a longitudinal slot 42 (FIGS. 7, 8, and 9). The longitudinal slot 42 is parallel to the support rails 14 and permits the transfer arm 40 to substantially freely travel back and forth horizontally within the slot 42. The drive arm 38 and the gear arm 36 cooperate to impart a reciprocating drive to the transfer arm 40. As illustrated in FIG. 7A, while the gear arm 36 orbits around the output shaft 34*a*, the proximal end 38*a* of the drive arm 38 is manipulated by the gear arm 36 at the connection pin 37. As the distal end 36*a* of the gear arm 36 is at one of its two maximum horizontal points of orbit (depicted respectively as H1 and H2 in FIG. 7A), the drive arm 38 is likewise at its respective maximum horizontal position. The distance between the maximum horizontal points of orbit of the gear arm 36 defines the longitudinal travel distance of the support platform 16. FIG. 7A depicts a first maximum horizontal position H1 of the gear arm 36 and drive arm 38 and a second maximum horizontal position H2, wherein position H2 is shown in phantom. In the illustrated embodiment of FIGS. 7, 7A, and 9, rod end bearings 44 are disposed at each end of linkage drive arm 38 to provide rotational connections between the gear arm 36, drive arm 38, and transfer arm 40 such that each end of the drive arm 38 is at least partially rotatable relative to the respective gear arm 36 or transfer arm 40.

The sieve retainer tray 18 has a generally cylindrical well 46 for retaining the sieve 20 in place on the platform 16 during oscillation of the platform 16 (FIGS. 4 and 6). The cylindrical well 46 is defined by a substantially vertical rim or wall 46*a* defining a circumference of the cylindrical well 46. While the wall 46*a* shown in the illustrated embodiments of FIGS. 1-6 is partially cut away on opposing sides of the tray 18, the wall 46*a* may be continuous and uninterrupted along the entire circumference of the well 46. The cylindrical well 46 is configured to receive and retain the lower portion of the sieve 20, wherein the inner diameter of the well 46 is at least slightly larger than the outer diameter of the sieve 20. The retainer tray 18 includes a pair of horizontal cylindrical cavities or sleeves 48 disposed at opposite ends of the tray 18, each sleeve 48 is configured to receive and retain a cylindrical vibratory motor 24. The perimeter of the tray 18 is sufficiently larger than the cylindrical well 46 such that the cylindrical sleeves 48 and vibratory motors 24 do not extend into the cylindrical well 46. The longitudinal axes of the cylindrical sleeves 48 and vibratory motors 24 as depicted in the illustrated embodiments of FIGS. 1-6 are horizontal and perpendicular to the support rails 14. However, the sleeves 48 may be oriented differently in other embodiments, such as parallel to the support rails 14 or at oblique angles relative to the support rails 14. Alternatively, the vibratory motors 24 may be coupled to an exterior portion of the retainer tray 18 and not disposed inside of a cavity in the tray 18. Optionally, vibratory motors may be coupled to the support platform 16 rather that the tray 18, or directly to the sieve 20. The integral relationship between the vibratory motors 24, cylindrical sleeves 48, and the retainer tray 18, facilitates vibratory motion transfer from the vibratory motors 24 into the retainer tray 18, and thereby to the sieve 20 to rapidly shake the sieve 20, to facilitate plant product separation.

It will be appreciated that the support platform 16 and/or retainer tray 18 may be omitted without substantially affecting the function of the apparatus 10. For example, the sieve 20 may be coupled directly to the slide mounts 32, the vibratory motors 24 may be coupled directly to a portion of the sieve 20, and the linkage assembly 23 may be coupled directly to a portion of the sieve 20. For another example, the retainer tray 18 may be coupled directly to the slide mounts 32 and the linkage assembly 23 may be coupled directly to a portion of the retainer tray 18.

Figure 10:
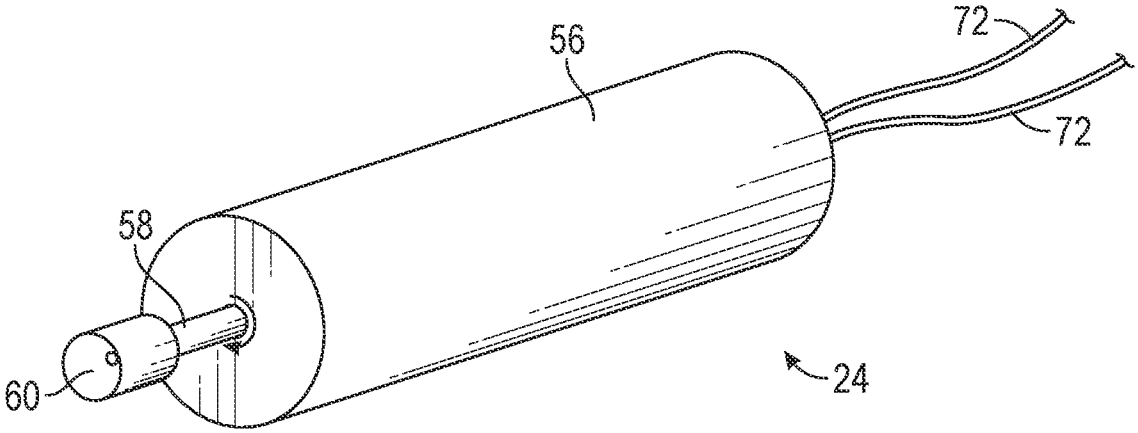
FIG. 10 is a perspective view of an eccentric rotating mass vibratory motor for the extraction apparatus of FIG. 1.

The vibratory motors 24 are cylindrical eccentric rotating mass motors, or coreless vibration motors, having a rotary motor 56 that spins a longitudinal drive shaft 58 (FIG. 10). An eccentrically mounted or off-center mass or weight 60 is disposed on the distal end of the drive shaft 58, wherein as the drive shaft 58 spins, the eccentrically mounted mass 60 causes an asymmetric centripetal force that is transferred to the drive shaft 58 and causes a vibration that acts substantially perpendicular to the longitudinal axis of the cylindrical motor 24. The vibration driven by the vibratory motors 24 can transfer to the retainer tray 18 in all directions that are substantially perpendicular to the longitudinal axis of the vibratory motors 24. As depicted in FIGS. 1-7, the vibration from the vibratory motors 24 would be directed perpendicular to the support rails 14 and in all directions horizontally, vertically, and obliquely depending on the orbit of the eccentric mass 60 relative to the drive shaft 58.

Figure 2:
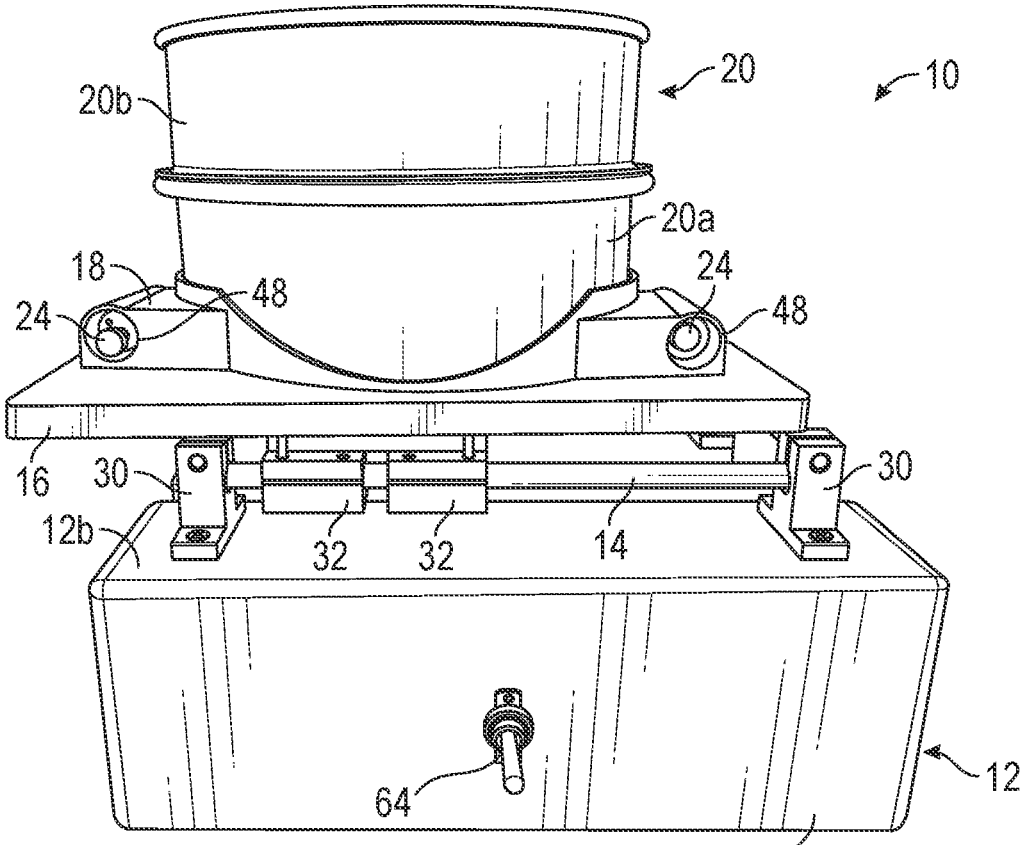
FIG. 2 is another front perspective view of the extraction apparatus of FIG. 1, depicting a support platform situated to a side of the apparatus.
Figure 3:
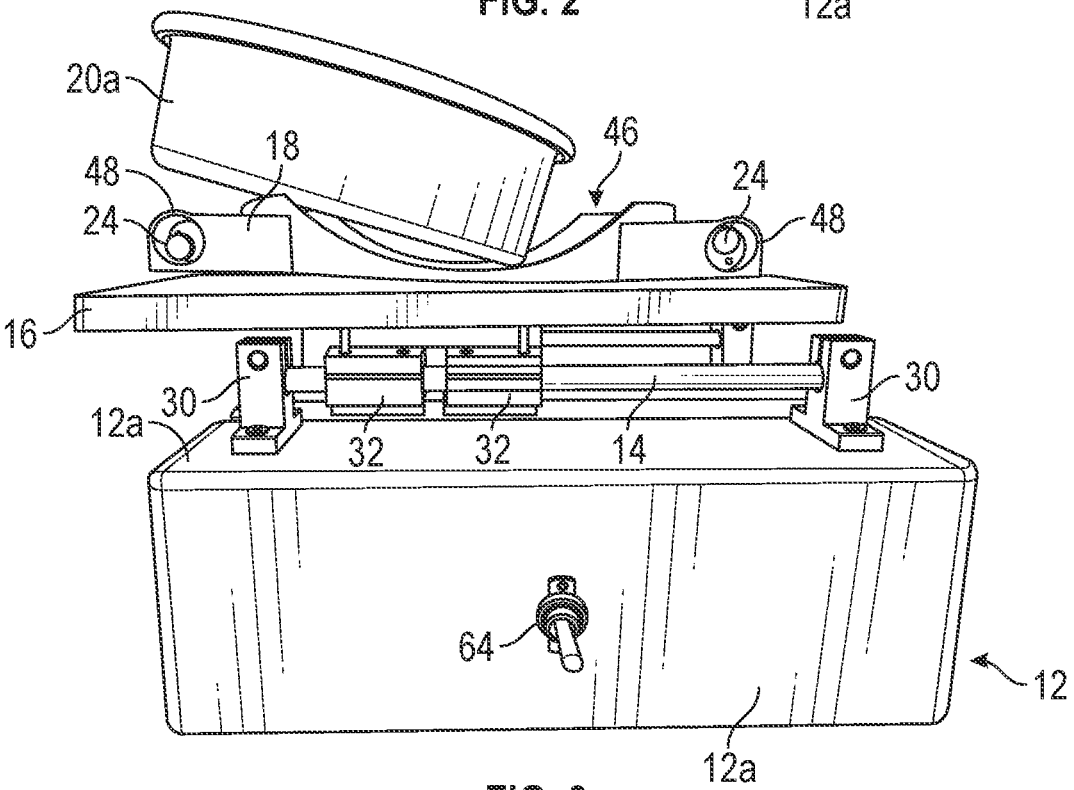
FIG. 3 is another front perspective view of the extraction apparatus of FIG. 1, depicting the support platform situated to a side of the apparatus and a plant matter tray partially removed from a sieve retention tray.
Figure 5:
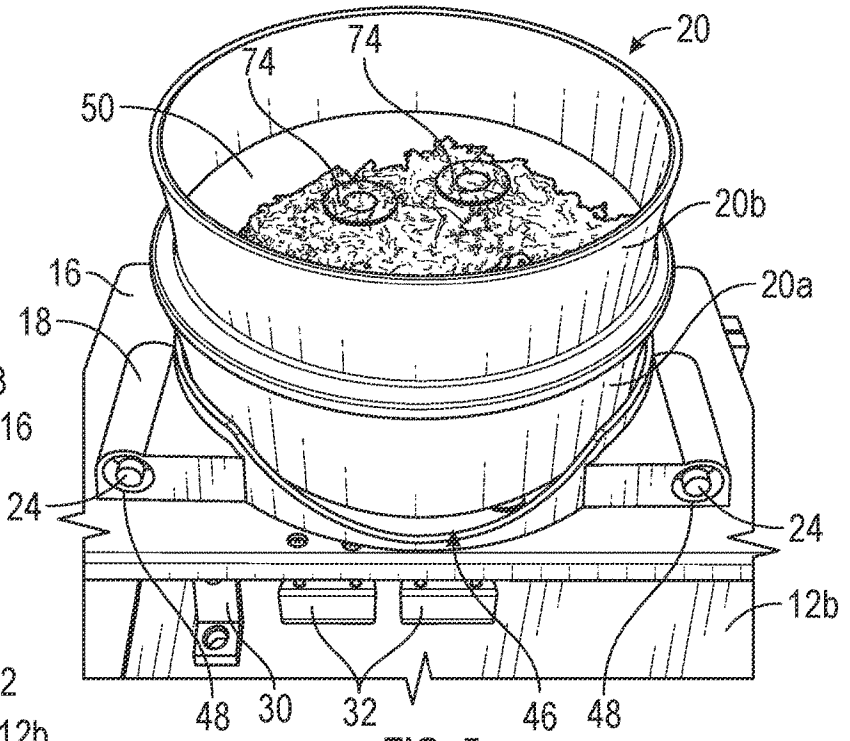
FIG. 5 is a perspective view of a sieve assembly and a sieve retention tray of the extraction apparatus of FIG. 1, depicting plant matter contained in a portion of the sieve assembly.

In the illustrated embodiments of FIGS. 1, 2, and 5, the plant product extraction apparatus 10 supports and agitates a sieve 20 that is defined by a standard test sieve that includes a lower collection pan 20*a* and an upper sieve pan 20*b*. The upper sieve pan 20*b* includes a mesh screen 50 disposed along a bottom opening of the sieve pan 20*b* to sift or grade the plant material (FIG. 5). The mesh screen 50 is chosen as a function of the size of the plant product or material that a user is intending to extract from the larger portion of the plant. As the plant product extraction apparatus 10 agitates the sieve 20, the plant material inside the upper sieve pan 20*b* is agitated along the mesh screen 50 such that particles smaller than the openings in the mesh screen 50 pass through the screen 50 and fall into the collection pan 20*a*. Material that remains larger than the openings in the mesh screen 50 remain inside the upper pan 20*b* above the screen 50. A cover 52 may be placed over the upper pan 20*b* to retain material inside the sieve 20 during operation of the apparatus 10 (FIG. 1). The cover 52 and each portion of the sieve 20 is removable to add, remove, or manipulate the plant matter in a respective portion of the sieve 20. The upper pan 20*b* and/or screen 50 must be removed to access the sifted plant matter from the lower collection pan 20*a*. Optionally, additional upper sieve pans may be included with the sieve 20, the additional sieve pans having varying sizes of mesh screens in order to grade different sizes of plant material. A sieve retention element 54 may be included to further retain the sieve 20 within the retainer tray 18 during operation of the apparatus 10 (FIG. 1). The retention element 54 may be a strap or a bungee cord coupled at each end to a portion of the retainer tray 18 and disposed over the top of the sieve 20, although other retention elements such as clips or threaded connections or fasteners are also envisioned.

A power source 62 provides electric power to the plant product extraction apparatus 10, including the rotary motor 34 of the motor assembly 22 and the rotary motor 56 of each vibratory motor 24 (FIG. 7). A power switch or control, such as a toggle switch 64 (see FIGS. 1-3), a button 66, and/or an adjustable dial 68 (see FIG. 4), is provided to enable, interrupt, or adjust the flow of electricity from the power source 62 to the apparatus 10. The adjustable dial 68 provides for voltage adjustment to increase or decrease the voltage supplied to the motors 34 and 56 to increase or decrease the speed of the motors. A display screen 70 is provided to display information to a user (FIG. 4), such as the voltage level based on the position of the adjustable dial 68 or a timer displaying a countdown of time left for operation. A plurality of wires 72 are routed through the plant product extraction apparatus 10 to distribute electricity to the motor assembly 22 and the vibratory motors 24 (FIGS. 7 and 9). Slack or excess length in the wires 72 may be provided to allow the wires 72 coupled to the vibratory motors 24 to move along with the support platform 16 as the apparatus 10 is being operated. The wires 72 are positioned such that they do not interfere or inhibit operation and locomotion of the extraction apparatus 10.

The plant product extraction apparatus 10 may include a plurality of free agitators 74 disposed within the sieve 20 to facilitate separation of the finer material from the plant by agitating the material inside the sieve 20 as the apparatus 10 is operated (FIG. 5). In the illustrated embodiment of FIG. 5, the agitators 74 are defined by circular metal plates, such as metal washers, however other shapes and materials may be define the agitators 74, such as balls or non-circular shapes. The agitators 74 rest on top of the screen 50 and are free to slide or translate within the upper sieve pan 20*b*. The agitators 74 contact and interact with the plant matter above the screen 50 to facilitate separation of the finer material from the large plant matter. The multiple modes/types of oscillation and/or vibration provided by the linear drive assembly 21 and the vibratory motors 24, along with the multiple agitators 74, cooperate to facilitate the separation of smaller particles from a larger plant specimen through the sieve screen 50.

Figure 11:
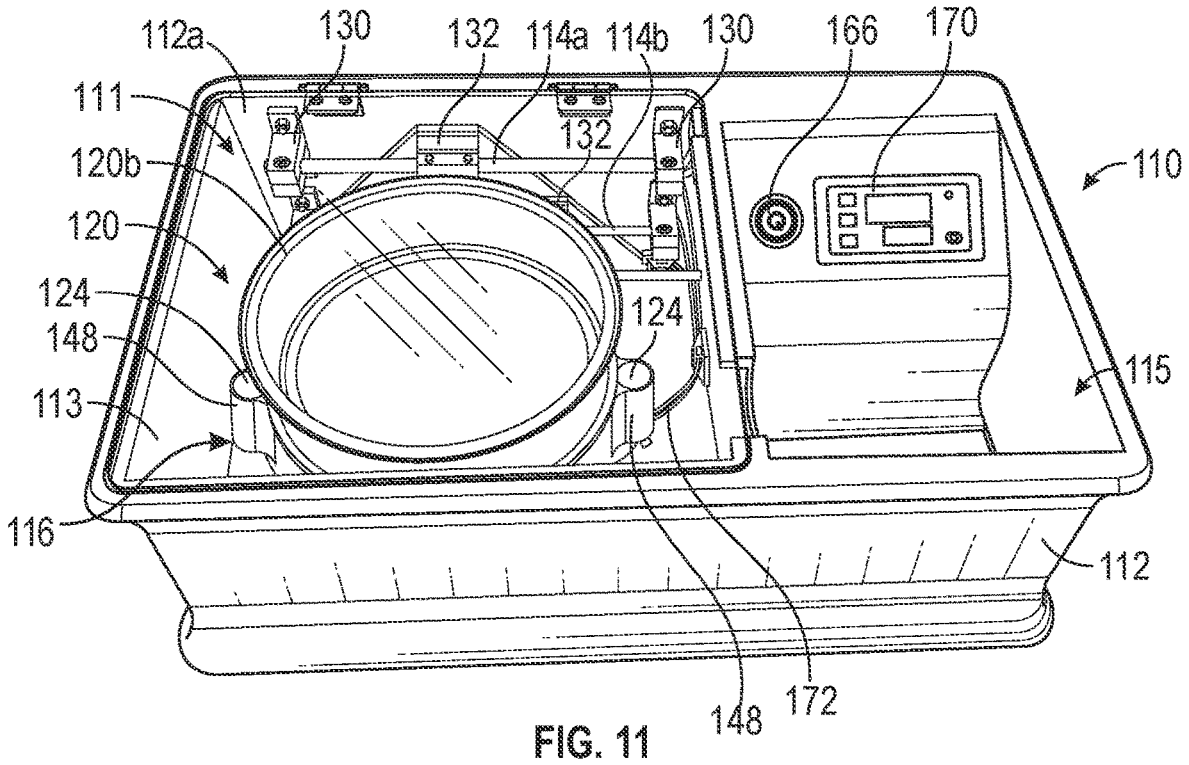
FIG. 11 is a top front perspective view of another plant product extraction apparatus in accordance with the present invention.
Figure 12:
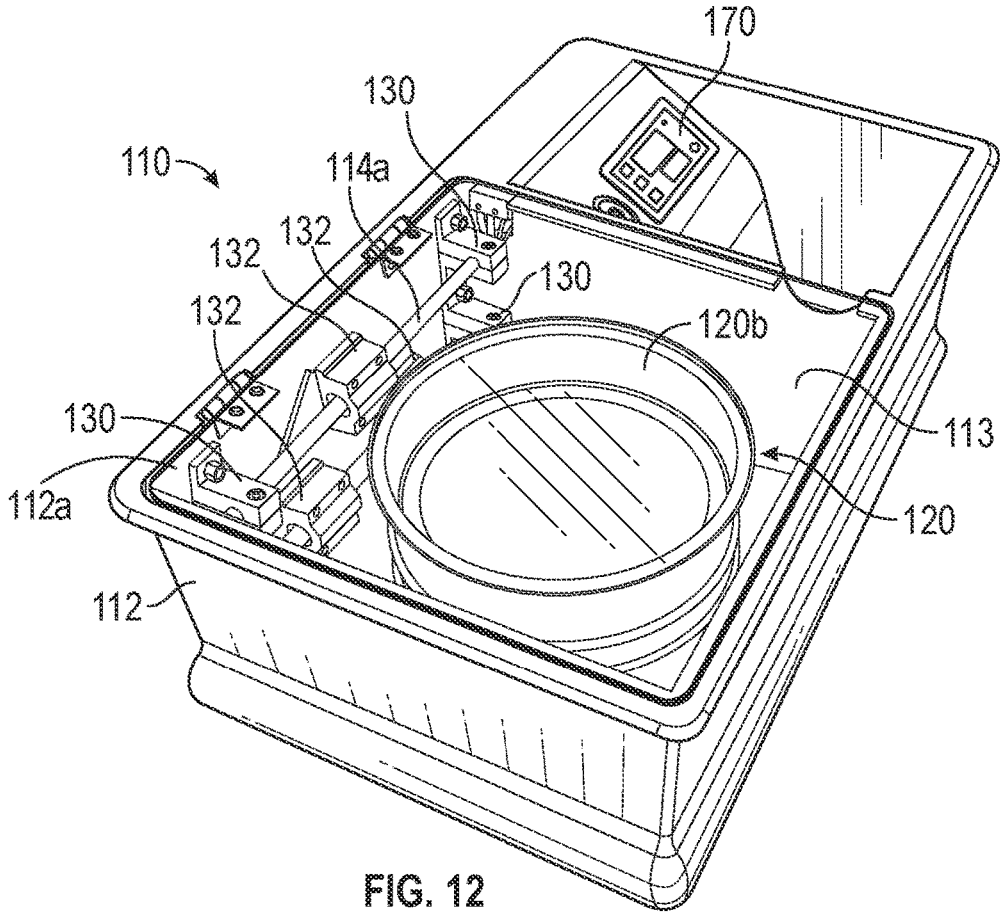
FIG. 12 is a top side perspective view of the plant product extraction apparatus of FIG. 11.

Referring to the illustrated embodiment of FIGS. 11-12, another plant product extraction apparatus 110 is similar to apparatus 10 in many respects and includes many similar structures to perform substantially similar functions. Significant differences between apparatus 110 and apparatus 10 are discussed further herein. Support rails 114*a*, 114*b* of apparatus 110 are mounted via rail end supports 130 to one side wall 112*a* of a support base 112 such that an upper one of the rails 114*a* is aligned substantially above the other or lower rail 114*b*. A plurality of slide mounts 132 are provided to support a sieve support 116 (FIG. 11), such as in the form of a platform, sieve retention platform or tray, and/or a sieve apparatus 120. For example, a single slide mount 132 may be provided along the upper rail 114*a* and a pair of slide mounts 132 may be provided along the lower rail 114*b*. The rails 114*a*, 114*b* define a linear oscillation path upon which the sieve support 116 and/or sieve apparatus 120 can be driven back and forth to agitate the sieve apparatus 120. The sieve support 116 of apparatus 110 may be, for example, a circular tray (similar to that of retention tray 18 of apparatus 10) or a rigid hoop or ring that is dimensioned to receive and retain a lower portion of the sieve apparatus 120. It will be appreciated that the sieve support 116 may be formed similar to the support platform 16 of apparatus 10, the sieve retention tray 18 of apparatus 10, or a combination or assembly of a support platform and sieve retention tray similar to platform 16 and tray 18 of apparatus 10. It will also be appreciated that the sieve support 116 may be omitted and the sieve apparatus 120 may be coupled directly to the slide mounts 132 without adversely affecting the oscillatory function of the apparatus 110. Support rails 114*a* and 114*b* function substantially similar to rails 14 discussed above for apparatus 10, and, as described previously, one of the rails 114*a* or 114*b* may be omitted without substantially affecting the operation of the apparatus 110.

Similar to vibratory motors 24 of apparatus 10, a pair of vibratory motors 124 are provided with apparatus 110 to impart a shaking vibration directly to the sieve support 116 and/or sieve apparatus 120 (FIG. 11). The vibratory motors 124 are disposed in vertical cylindrical cavities or sleeves 148 at generally opposite sides of the sieve support 116 or the sieve apparatus 120 (FIG. 11). The apparatus 110 includes a motor assembly or drive mechanism to provide locomotion to the sieve support 116 or sieve apparatus 120 to drive the sieve apparatus 120 in a back and forth motion relative to the rails 114*a*, 114*b*. Similar to that described above for apparatus 10, the motor assembly of apparatus 110 and the vibratory motors 124 can be operated simultaneously to impart both back and forth oscillation and shaking vibration to the sieve apparatus 120 at the same time. For aesthetic, safety, or other purposes, the motor assembly may be disposed in a covered portion of the support base 112 to protect the motor assembly from damage and/or to reduce or eliminate the possibility of injury to the user during operation of the apparatus 110. A linkage assembly may be provided between the motor assembly and the sieve support 116 of apparatus 110, similar to the linkage assembly 23 of apparatus 10 as described above. The linkage assembly for apparatus 110 may include an arm or element that is disposed through an opening or gap defined in the support base 112 to drive the sieve support 116 while the motor assembly is disposed in a covered portion of the support base 112.

The support base 112 of apparatus 110 includes a hollow or open operation chamber 111 in which most, if not all, moving parts of the apparatus 110 are disposed, including the rails 114*a*, 114*b*, sieve support 116, and sieve apparatus 120 (FIGS. 11-12). The hollow chamber 111 allows the moving parts of the apparatus 110 to be protected within the envelope of support base 112. In other words, users of the apparatus 110 are protected from the moving parts of the apparatus because the moving parts are all disposed within the chamber 111. As such, the operation movements of the apparatus 110 are confined within an envelope defined by the chamber 111 and the overall volumetric perimeter of the support base 112. A lid or cover 113 is hingedly coupled to the support base to cover the hollow chamber 111 to provide additional safety precautions to reduce or eliminate the possibility of a user inserting a body part into the chamber 111 and becoming injured by the operation of the apparatus 110.

A hollow or open control chamber 115 is formed in a portion of the support base 112 adjacent to the operation chamber 111 (FIGS. 11-12). An on/off switch or button 166 and a display screen 170 are mounted in the control chamber 115. The on/off button 166 and display screen 170 may function in similar fashion to button 66 and screen 170 of apparatus 10 as described above. The display screen 170 be multi-functional and may include buttons, switches, touch-screens, or the like, to control various functions of the apparatus 110. For example, the display screen 170 interface may allow a user to alter the operation or function of the motor assembly and the vibratory motors 124 independent of one another, or in combination with one another, to impart different oscillatory/vibration patterns to the sieve apparatus 120. Similar to wires 72 of apparatus 10, apparatus 110 includes a plurality of wires 172 routed through the plant product extraction apparatus 110 to distribute electricity to the motor assembly and the vibratory motors 124. A cover, similar to cover 52 of apparatus 10, may be placed over the upper pan 120*b* to retain material inside the sieve apparatus 120 during operation of the apparatus 110.

Thus, the plant product extraction apparatus of the present invention provides an apparatus for separating fine plant particles or material from a larger portion of a plant, such as separating trichomes from a stalk or flower of a plant. The apparatus imparts a plurality of different oscillations and vibrations to a sieve apparatus that holds the plant matter. Different modes or patterns of oscillation/vibration can be achieved due to the operation of multiple motors to impart various forms of oscillation/vibration to the sieve apparatus. Oscillation/vibration patterns that can be achieved include back and forth horizontal sliding and rapid shaking. A motor and gear assembly drives a linkage assembly to move a support platform back and forth horizontally along a pair of support rails. A sieve retention tray is supported by the support platform and retains a sieve apparatus on the support platform as the platform slides back and forth. Vibratory motors disposed in the retention tray provide rapid shaking vibration to through the tray to the sieve apparatus. Agitators may be placed inside of the sieve apparatus to facilitate the separation of the plant materials. The coordination between the various motors and oscillations/vibrations facilitates the separation of finer plant materials from a larger portion of a plant.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A particle extractor for separating smaller particles of a material from a larger portion of the material, said particle extractor comprising:

a particle separator adapted for sifting or grading extracted material;

a support rail assembly for moveably supporting said separator;

an oscillator configured to move said separator in an oscillatory motion along a support rail path defined by said support rail assembly; and a vibrator between said particle separator and said support rail assembly to impart a vibratory motion to said separator, said vibrator moveable with said separator relative to said support rail assembly;

wherein said oscillator and said vibrator are selectively operable to move said separator to facilitate separation of small particles from a larger portion of the material.

2. The particle extractor of claim 1, further comprising a separator retention tray coupled with said support rail assembly and configured to support and retain said separator during operation of said particle extractor, wherein said retention tray is operable to move back and forth along said support rail path, and wherein said oscillator is configured to mechanically drive said retention tray along said support rail path in a back and forth oscillatory pattern.

3. The particle extractor of claim 2, further comprising a support platform coupled to said support rail assembly and configured to support said retention tray apart from said support rail assembly, wherein said support platform is configured to move back and forth horizontally along said support rail path.

4. The particle extractor of claim 3, wherein said support rail assembly comprises a horizontal slide rail and a slide mount slideably coupled to said horizontal slide rail, wherein said support platform is coupled to said slide mount.

5. The particle extractor of claim 4, wherein said oscillator comprises a motor coupled to a first end of a linkage assembly such that said motor drives said linkage assembly in a reciprocating motion, said linkage assembly is coupled at a second end to said support platform, wherein said reciprocating motion of said linkage assembly drives said horizontal back and forth along said support platform.

6. The particle extractor of claim 3, further comprising isolators disposed between said support platform and said retention tray, wherein said isolators are adapted to enable limited vertical and horizontal translation of said retention tray relative to said support platform.

7. The particle extractor of claim 2, wherein said vibrator comprises a vibratory motor disposed at said retention tray and adapted to impart vibratory motion to said retention tray and thereby to said separator.

8. The particle extractor of claim 1, further comprising a plurality of agitators disposed inside of said separator and configured to facilitate separation of smaller particles of the material from a larger portion of the material.

9. A plant matter extractor for separating plant materials, said extractor comprising:

a support base;

a support rail assembly comprising a guide rail coupled to said support base;

a support platform moveably coupled to said guide rail and configured to move freely about said guide rail along a travel path defined by said guide rail;

a particle separator supported at said support platform and adapted for sifting or grading a plant material;

a drive assembly adapted to drive said support platform back and forth along said guide rail relative to said support base; and a vibratory motor coupled to and moveable with said support platform along said guide rail, said vibratory motor adapted to shake said support platform and thereby shake said separator supported at said support platform;

wherein said drive assembly and said vibratory motor are selectively operable to vibrate said separator to facilitate separation of smaller plant materials from a larger portion of a plant.

10. The plant matter extractor of claim 9, wherein said drive assembly comprises a motor coupled to a first end of a linkage assembly such that said motor drives said linkage assembly in a reciprocating motion that is generally parallel to said guide rail, said linkage assembly is coupled at a second end to said support platform, wherein said reciprocating motion of said linkage assembly drives a back and forth oscillation of said support platform along said guide rail.

11. The plant matter extractor of claim 10, further comprising another vibratory motor, said vibratory motor and said another vibratory motor disposed at opposite ends of said support platform relative to one another.

12. The plant matter extractor of claim 11, wherein each of said vibratory motors comprises an eccentric rotating mass motor having a cylindrical body with a longitudinal axis oriented perpendicular to said guide rail, wherein said vibratory motor is configured to impart a vibration to said support platform in a direction perpendicular to the longitudinal axis of said vibratory motor.

13. The plant matter extractor of claim 9, further comprising a plurality of agitators disposed inside of said separator, wherein said drive assembly, said vibratory motor, and said plurality of agitators cooperate to facilitate separation of smaller plant materials from a larger portion of a plant.

14. The plant matter extractor of claim 9, further comprising a retention tray coupled to said support platform and configured to receive and retain said separator relative to said support platform.

15. The plant matter extractor of claim 14, wherein said vibratory motor is disposed at said retention tray and comprises an eccentric rotating mass motor having a cylindrical body with a longitudinal axis oriented perpendicular to said guide rail, wherein said vibratory motor is configured to impart a vibration to said retention tray in a direction perpendicular to the longitudinal axis of said vibratory motor.

16. A particle extractor for separating smaller particles of a material from a larger portion of the material, said extractor comprising:

a support base comprising a support rail at a portion of said support base;

a particle separator adapted for sifting or grading the plant material;

a retention platform moveably coupled to said support rail and configured to move freely along said rail in the direction parallel to said support rail, said retention platform configured to receive and retain said separator during operation of said particle extractor;

a drive assembly adapted to drive said retention platform back and forth along said support rail relative to said support base; and a pair of vibratory motors disposed at opposite ends of said retention platform and adapted to shake said separator retained at said retention platform;

wherein said drive assembly and said vibratory motor are selectively operable to vibrate said separator to facilitate separation of smaller material particles from a larger portion of a material.

17. The particle extractor of claim 16, wherein said drive assembly comprises a motor coupled to a first end of a linkage assembly such that said motor drives said linkage assembly in a reciprocating motion that is generally parallel to said support rail, said linkage assembly is coupled at a second end to said retention platform, wherein said reciprocating motion of said linkage assembly drives said retention platform along said support rail in a back and forth oscillatory pattern.

18. The particle extractor of claim 16, wherein each of said vibratory motors comprises an eccentric rotating mass motor having a cylindrical body with a longitudinal axis oriented perpendicular to said support rail, wherein said vibratory motor is configured to impart a vibration to said retention platform in a direction perpendicular to the longitudinal axis of said vibratory motor.

19. The particle extractor of claim 16, further comprising a plurality of agitators disposed inside of said separator, wherein said drive assembly, said vibratory motor, and said plurality of agitators cooperate to facilitate separation of smaller material particles from a larger portion of the material.

20. The particle extractor of claim 16, wherein said support base further comprises a hollow chamber formed in an interior of said support base, wherein said support rail, said separator, said retention platform, said drive assembly, and said vibratory motor are each disposed inside of said hollow chamber such that operation movements of said particle extractor are confined within an envelope defined by said hollow chamber.

* * * * *